US005852892A

United States Patent [19]

Bilgeri et al.

[11] Patent Number: 5,852,892

[45] Date of Patent: Dec. 29, 1998

[54] RIFLE WITH BIPOD

[75] Inventors: Elmar Bilgeri; Ulrich Zedrosser, both of Steyr, Austria

[73] Assignee: Steyr-Daimler-Puch AG, Austria

[21] Appl. No.: 925,225

[22] Filed: Sep. 8, 1997

[30] Foreign Application Priority Data

Sep. 10, 1996 [AT] Austria ..... 527/96

[51] Int. Cl.[6] ..... F41C 27/00

[52] U.S. Cl. ..... 42/94; 42/72

[58] Field of Search ..... 42/94, 72; 89/37.04, 89/37.03

[56] References Cited

U.S. PATENT DOCUMENTS

| | | | |
|---|---|---|---|
| 1,375,487 | 4/1921 | Butler | 42/94 |
| 1,382,409 | 6/1921 | Butler | 42/94 |
| 1,441,285 | 1/1923 | Johnson et al. | 42/94 |
| 2,420,267 | 5/1947 | Sefried | 42/94 |
| 2,436,349 | 2/1948 | Adams | 42/94 |
| 2,489,283 | 11/1949 | Garand | 42/94 |
| 2,775,052 | 12/1956 | Musser et al. | 42/94 |
| 2,807,904 | 10/1957 | Kreske | 42/94 |
| 3,235,997 | 2/1966 | Stoner | 42/94 |
| 3,327,422 | 6/1967 | Harris | 42/94 |
| 3,445,082 | 5/1969 | Proctor et al. | 248/186 |
| 3,938,273 | 2/1976 | Tellie | 42/94 |
| 4,625,620 | 12/1986 | Harris | 89/37.04 |
| 5,029,407 | 7/1991 | Kirkpatrick | 42/94 |

*Primary Examiner*—Charles T. Jordan
*Assistant Examiner*—Meena Chelliah
*Attorney, Agent, or Firm*—Bachman & LaPointe, P.C.

[57] ABSTRACT

A rifle has a fore-end to which a bipod is fitted which comprises a support part and retractable legs, the support part and the legs being connected by means of pins, which are thickened at their outer end and have a cut-off sector, and depressions with an interrupted circumferential lip. In order to provide a simple, cheap and elegant bipod, the support part is mounted on the fore-end such that it can rotate about a shaft located in the firing direction, the pins are part of the leg and the associated depressions are provided in the support part, and the support part and leg have a circular groove and a circular bead which fits into the groove and projects in the direction of the axis of symmetry of the pin, the axis of the groove and bead being the same as the axis of symmetry of the pin, and their diameter being larger than the maximum diameter of the pin.

8 Claims, 3 Drawing Sheets

RIFLE WITH BIPOD

BACKGROUND OF THE INVENTION

The invention relates to a rifle with a fore-end to which a bipod is fitted which comprises a support part and retractable legs, the support part and the legs being connected by means of pins, which are thickened at their outer end and have a cut-off sector, and depressions with an interrupted circumferential lip.

A rifle having such a bipod has been disclosed, for example, in U.S. Pat. No. 3,938,273. This requires a complex spring mechanism to fix the legs in the extended and retracted position and is heavy and cumbersome overall. Even in the retracted state, parts project, which means a risk of injury and has an adverse effect on the appearance of the weapon.

Such bipods are normally provided on military weapons. For the above reasons, it has never been possible to use them for hunting and sporting weapons. However, they would be desirable there to allow them to be aimed while placed on the ground even in unfavorable terrain.

It is thus the principle object of the present invention to provide a bipod which does not have these disadvantages and can be used for a hunting or sporting weapon.

SUMMARY OF THE INVENTION

The foregoing object is achieved according to the present invention wherein:

(a) the support part is mounted on the fore-end such that it can rotate about a shaft located in the firing direction, (b) furthermore, the pins are part of the leg and the associated depressions are provided in the support part, the axes of the depressions and pins being arranged inclined upward in a plane which is substantially transverse with respect to the firing direction, (c) and finally, the support part and the leg are designed such that one has a circular groove and the other has a circular bead which fits into the groove and projects in the direction of the axis of the pin, the axis of the groove and bead being the same as the axis of the pin, and their diameter being larger than the maximum diameter of the pin.

As a result of (a) above, the bipod is connected to the rifle such that it can pivot about the longitudinal axis so that it can be placed down even on inclined terrain without the sight axis no longer coinciding with the vertical plane through the barrel axis.

With the axes inclined according to (b) above, the legs can be placed in the straddled position even when they are straight and flat; the depressions in the support part mean that there are no parts which point outward and could lead to injuries. The base surface of the leg rests entirely, on the side surface of the support part, which is inclined upward in a suitable manner, thus also ensuring good lateral guidance.

The groove and bead according to (c) above, further improve the guidance and act as a friction brake. In addition, they protect the pins against being overstressed by tension and bending.

In one advantageous version, the shaft, located in the firing direction, of the support part is firmly connected to the latter and is secured against pulling out by a transverse pin in the fore-end. The transverse pin, which is eccentric with respect to the shaft of the support part, and the transverse groove in the shaft, which has a convex V-shape, limit the possible angular movement of the support part. The support part can easily be removed from the fore-end by pulling on the transverse pin, for example in order to remove the legs in the position where they are pivoted upward and could not otherwise be reached, and to allow them to be cleaned.

The advantages mentioned above allow the legs to be made of plastic without having to accept any loss of robustness and strength. At the same time, the roots of the pins, which are made of metal, can be extrusion coated. This makes possible a particular light and elegant configuration.

Semi-rigid locking in the respective position can be achieved by the support part having, outside the bead, a ramp which interacts with the base surface of the leg. This means that the springs, which are otherwise required, are superfluous.

Furthermore, the legs and fore-end can be designed such that, in the retracted state, the legs form a part of the surface of the fore-end. It is then absolutely impossible to see that a bipod is present at all. The picture of an elegant hunting weapon with a modern shape is then not impaired by anything. Finally, the legs can be securely latched in the retracted position by small projections on the legs or on the fore-end.

BRIEF DESCRIPTION OF THE DRAWINGS

The invention is described in further detail with reference to the following text and figures wherein.

DETAILED DESCRIPTION OF THE PREFERRED EMBODIMENT(S)

Figure 1:
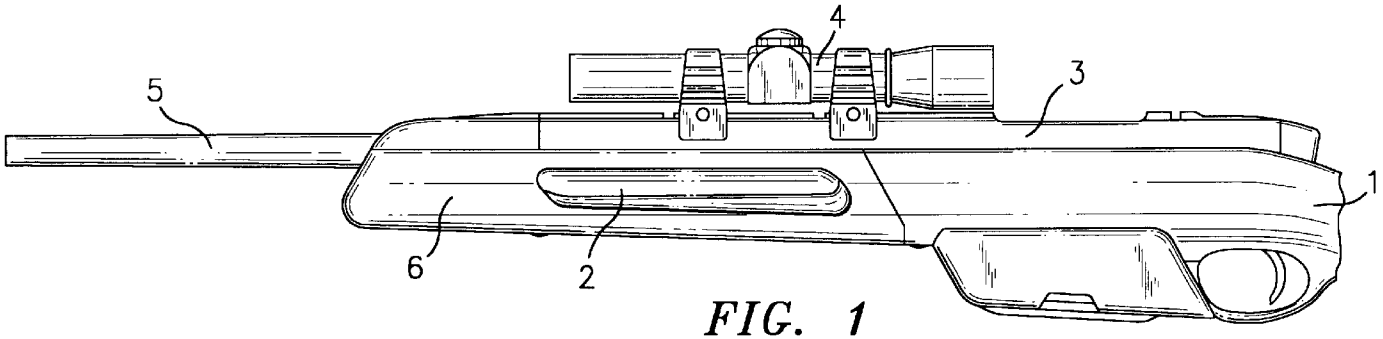
FIG. 1 shows a side view of the fore-end of a rifle according to the invention with the bipod retracted.
Figure 2:
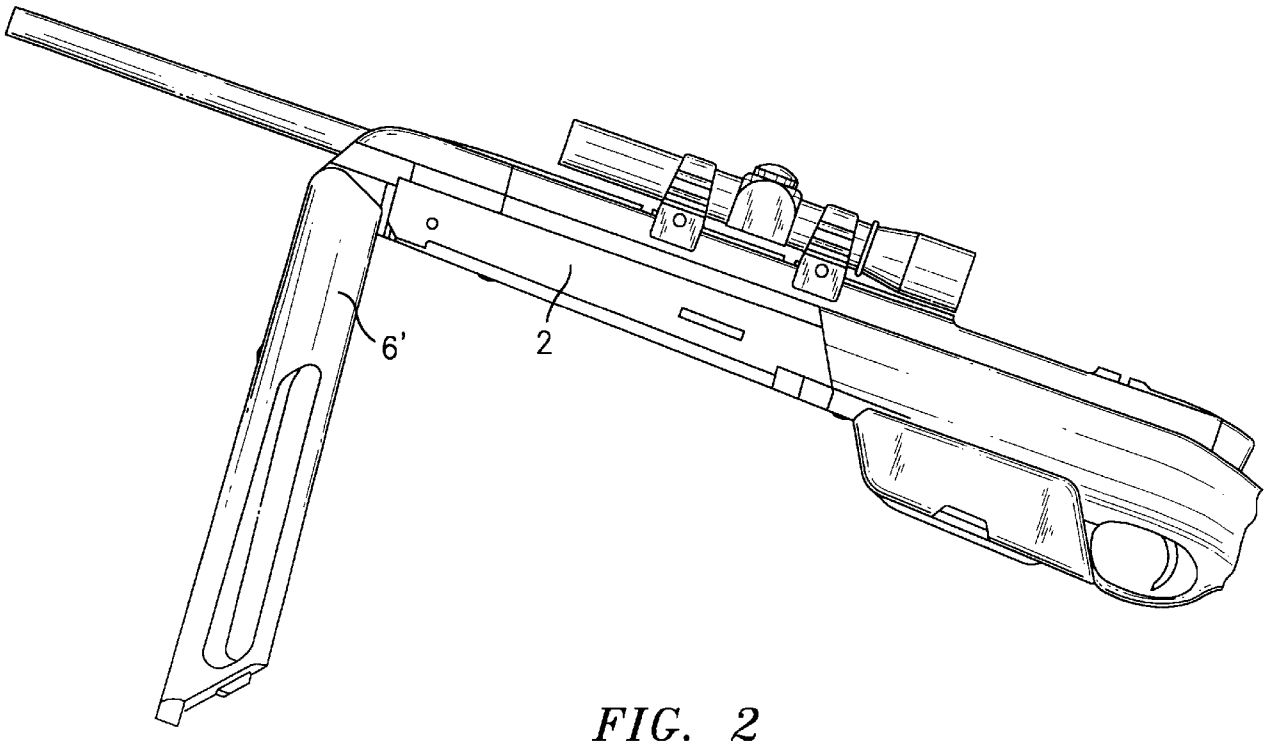
FIG. 2 is as FIG. 1, but with the bipod extended.

On the rifle which is illustrated in FIGS. 1 and 2, the stock is designated by 1, and the fore-end by 2. The two are connected to a housing 3, which is fitted with an aiming telescope 4 and the barrel 5. A leg 6 is provided on each side of the fore-end 2, and the two legs 6 form a bipod. In the retracted position (FIG. 1), this cannot be seen because the leg 6 is arranged without any gap in the overall shape of the fore-end 2.

FIG. 2 shows the leg 6 in the extended position 6', and the fore-end 2 is now visible.

Figure 3:
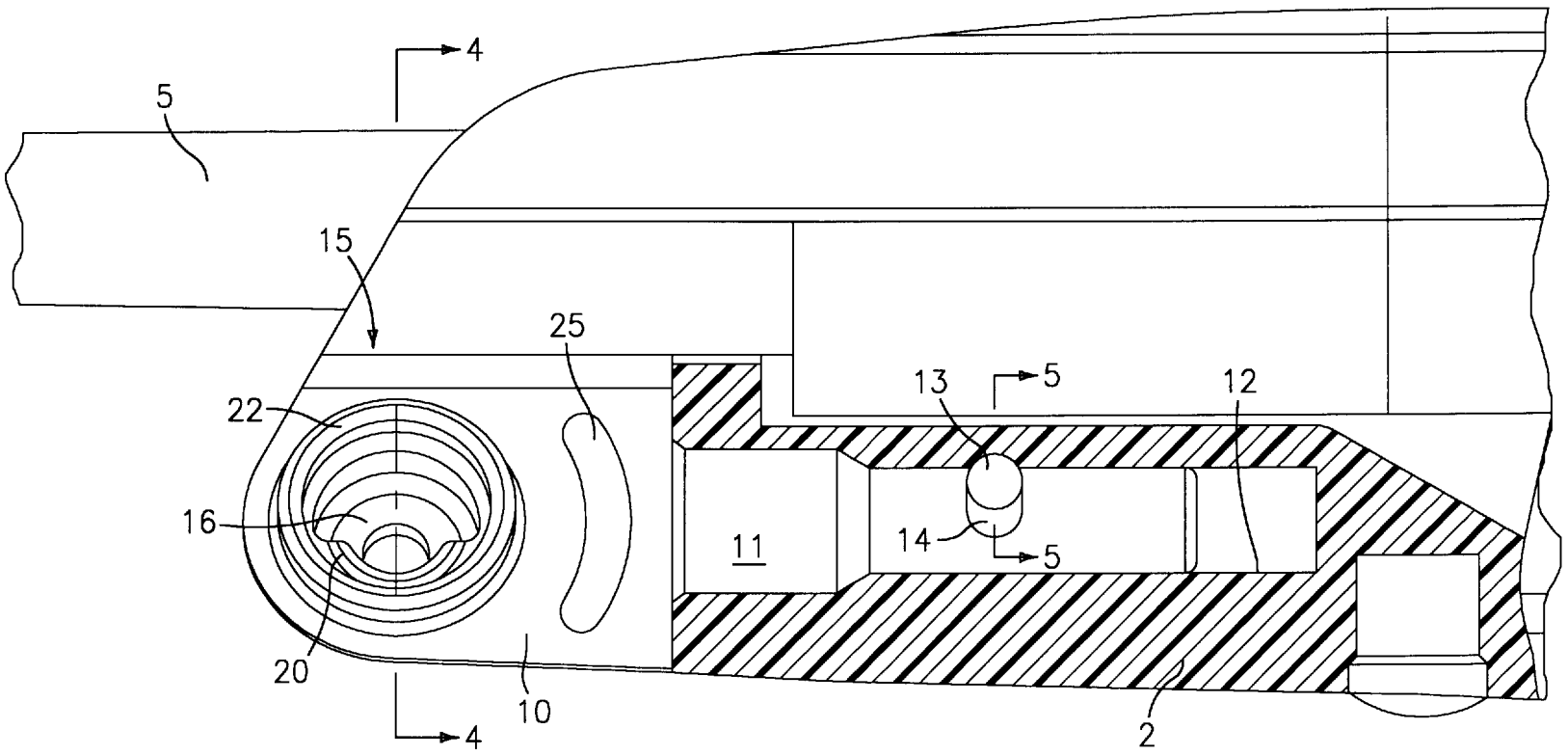
FIG. 3 shows a partial vertical section, enlarged.
Figure 4:
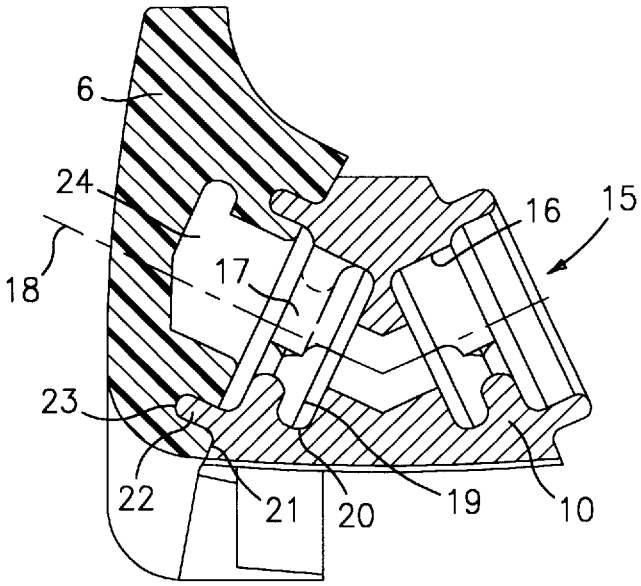
FIG. 4 shows a cross section along IV—IV in FIG. 3.
Figure 5:
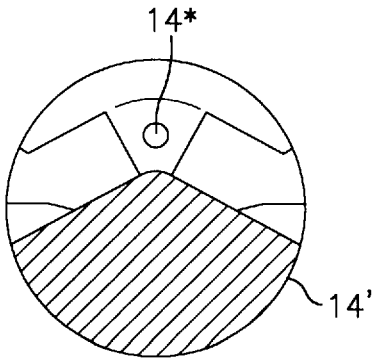
FIG. 5 shows an enlarged cross-sectional view of the pin 13 of FIG. 3.

FIGS. 3 and 4 show the parts which relate to the bipod enlarged. A shaft 11, which is integral with a support part 10, is seated in a longitudinal bore 12 at the front end of the fore-end 2 such that it can rotate. A transverse pin 13 which passes through the fore-end 2 engages in a transverse groove 14, which is concave and V-shaped shaped, as designated by 14*. The circle which circumscribes the groove 14' is a cross section through the shaft 11, rotated into the plane of the drawing. The support part 10 can thus pivot about the shaft 11 within the limits provided by the transverse groove 14.

15 designates the connection between the leg 6 and the support 10 in general. It comprises, on both sides of course, a recess 16 in the support part 10, and a pin 17 in the recess (FIG. 4). The two items have a common axis of symmetry 18. The pin 17 has a thickened end 19 which engages behind an interrupted circumferential lip 20, and that base surface of the leg 6 which touches the support part 10 has a circumferential groove 23, which surrounds a pin 17 and in which a bead 22 engages which is part of the support part 10.

24 designates the root of the pin 17, by means of which said pin 17 is introduced, for example, into a leg 6 which is made, for example, of plastic.

The leg is held in the extended position and the retracted position by the cut-off sector of the pin 17 (which cannot be seen) and the interrupted circumferential lip 20, but can be withdrawn from the support part 10 in the upward-pivoted position (FIG. 4). The bead 22 and groove 23 increase the guidance length of the leg 6 with the pin 17 in the support part 10, and thus considerably improve the strength of the connection 15.

In order to prevent the leg 6 remaining in an intermediate position, that is to say neither completely extended nor completely retracted, a ramp 25 can be provided, which falls away towards its ends. This is possible because of the elasticity of a leg 6 made of plastic. The same characteristic also allows the leg to latch (although this is not illustrated) with parts of the fore-end 2 in order to hold the leg securely locked in the retracted position.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A rifle comprises a stock and a fore-end portion connected together by a housing, and a barrel fitted on the housing, said fore-end portion having a bore extending parallel to said barrel, a support means rotatably mounted in said bore for supporting a bipod having first and second legs each having a connecting pin means associated therewith, said support means includes a shaft portion received in said bore and a support part, said support part being provided with a pair of upwardly inclined opposed recesses extending substantially traverse to said barrel, wherein said connecting pin means has one end secured in each recess of said support part, a circular bead provided around one of the support part recesses and the bipod leg connecting pin means and a circular groove provided around the other of the support part recesses and the bipod leg connecting pin means wherein the circular bead is received in the circular groove and wherein the circular bead, the circular groove, the connecting pin means and the recess in the support part for each leg have a common axis of symmetry.

2. The rifle according to claim 1, wherein the shaft of the support means is firmly connected to the latter and is secured in the bore by a transverse pin in the fore-end.

3. The rifle according to claim 2, wherein the transverse pin is eccentric with respect to the shaft of the support means, and the shaft has a transverse groove with a convex V-shape.

4. The rifle according to claim 1, wherein the legs of the bipod are made of plastic extruded around the connecting pin means which is made of metal.

5. The rifle according to claim 1, wherein the circular grooves are formed on a surface of each bipod leg and the circular beads are formed on opposed surfaces of the support part.

6. The rifle according to claim 1, wherein the legs are flush with the fore-end when retracted.

7. The rifle according to claim 6, including means for latching the legs with the fore-end when retracted.

8. The rifle according to claim 5, wherein the opposed surfaces of the support part are each provided with a ramp outside the circular bead wherein the ramp interacts with the surface of each bipod leg.

* * * * *